US007046199B2

(12) United States Patent
Montgomery et al.

(10) Patent No.: US 7,046,199 B2
(45) Date of Patent: May 16, 2006

(54) MONOLITHIC LOW PROFILE OMNI-DIRECTIONAL SURFACE-MOUNT ANTENNA

(75) Inventors: Mark Montgomery, Melbourne Beach, FL (US); Jason M. Hendler, Indian Harbour Beach, FL (US); Frank M. Caimi, Vero Beach, FL (US)

(73) Assignee: SkyCross, Inc., Melbourne, FL (US)

( * ) Notice: Subject to any disclaimer, the term of this patent is extended or adjusted under 35 U.S.C. 154(b) by 0 days.

(21) Appl. No.: 10/779,562

(22) Filed: Feb. 13, 2004

(65) Prior Publication Data

US 2004/0217910 A1 Nov. 4, 2004

Related U.S. Application Data

(60) Provisional application No. 60/447,244, filed on Feb. 13, 2003.

(51) Int. Cl.
*H01Q 1/24* (2006.01)

(52) U.S. Cl. ..... 343/700 MS; 343/752; 343/770

(58) Field of Classification Search ..... 343/700 MS, 343/752, 767, 770, 829, 846, 848
See application file for complete search history.

(56) References Cited

U.S. PATENT DOCUMENTS 3,838,429 A 9/1974 Reggia
3,967,276 A 6/1976 Goubau
5,181,044 A 1/1993 Matsumoto et al.
5,293,176 A 3/1994 Elliot
5,526,003 A * 6/1996 Ogawa et al. ..... 343/700 MS
5,646,634 A * 7/1997 Bokhari et al. ..... 343/700 MS
5,926,137 A 7/1999 Nealy
6,057,802 A 5/2000 Nealy et al.
6,292,152 B1 9/2001 Cosenza et al.
6,639,560 B1 * 10/2003 Kadambi et al. .... 343/700 MS
6,788,265 B1 * 9/2004 Kuramoto ..... 343/752
6,831,607 B1 * 12/2004 Hebron et al. ..... 343/700 MS
6,874,222 B1 * 4/2005 Lebaric et al. ..... 29/600

OTHER PUBLICATIONS

Goubau, G.; "Multi–Element Monopole Antennas"; pp. 63–67; publication information unknown.

Fujimoto, K., et al; "Small Antennas"; Research Studies Press Ltd., Letchworth, Hertfordshire, England; 1987; textbook, p. 16.

* cited by examiner

*Primary Examiner*—Tho Phan
(74) *Attorney, Agent, or Firm*—John L. DeAngelis, Jr.; Beusse Brownlee Wolter Mora & Maire, P.A.

(57) ABSTRACT

A monolithic surface mountable monopole antenna. The antenna comprises a top plate having a plurality of conductive regions and a like plurality of legs extending away from a plane of the top plate in a direction of a ground plane. Each leg is disposed between two adjacent conductive regions. In an embodiment wherein the top plate comprises four conductive regions, two of the four legs are connected to an underlying ground plane and two of the legs are connected to a signal feed conductor.

15 Claims, 3 Drawing Sheets

MONOLITHIC LOW PROFILE OMNI-DIRECTIONAL SURFACE-MOUNT ANTENNA

This application claims the benefit of the provisional patent application entitled Monolithic Low Profile Omni-Directional Surface-Mount Antenna filed on Feb. 13, 2003, and assigned application Ser. No. 60/447,244.

FIELD OF THE INVENTION

The present invention is directed generally to an antenna for transmitting and receiving electromagnetic signals, and more specifically to a low-profile omni-directional surface mountable antenna.

BACKGROUND OF THE INVENTION

It is generally known that antenna performance is dependent on the size, shape, and material composition of constituent antenna elements, as well as the relationship between the wavelength of the received/transmitted signal and certain antenna physical parameters (that is, length for a linear antenna and diameter for a loop antenna). These relationships and physical parameters determine several antenna performance characteristics, including: input impedance, gain, directivity, signal polarization, radiation resistance and radiation pattern.

Generally, an operable antenna should have a minimum physical antenna dimension on the order of a half wavelength (or a quarter wavelength above a ground plane) of the operating frequency to limit energy dissipated in resistive losses and maximize transmitted energy. Antennas having an operative dimension of a half wavelength or multiples thereof, are commonly used. Certain antennas present an electrical dimension that is not equivalent to a physical dimension of the antenna. Such antennas should therefore exhibit an electrical dimension that is a half wavelength (or a quarter wavelength above a ground plane) or a multiple thereof.

The burgeoning growth of wireless communications devices and systems has created a need for physically smaller, less obtrusive and more efficient antennas that are capable of wide bandwidth operation, multiple frequency band operation and/or operation in multiple modes (e.g., selectable signal polarizations and selectable radiation patterns).

The relatively small packaging envelopes of current handheld communications devices may not provide sufficient space for the conventional quarter and half wavelength antennas. In many applications, the antenna is therefore mounted so as to protrude from the device package, subjecting the external protrusion to damage, especially when carried by the user or when stored within a carrying-case. Thus a physically smaller antenna for mounting within the compact environment of a handset package and operational in the frequency bands of interest is especially sought after. Such an antenna must also provide other desired antenna operating properties, e.g., matched input impedance, radiation pattern, signal polarizations, etc. To further complicate the antenna packaging issue, it is known to those skilled in the art that there is a direct relationship between antenna gain and antenna physical size. Increased gain requires a physically larger antenna, while handset manufacturers continue to demand physically smaller antennas with increased gain characteristics.

The electronic components of a wireless communications device are typically mounted on a printed circuit board enclosed within a case. To reduce the burden of incorporating the antenna into such devices, the antenna mounting structure should be compatible with printed circuit board fabrication and assembly techniques. Specifically, a surface-mount antenna configuration, i.e., wherein the antenna is mounted to a surface of the printed circuit board, permits relatively easy physical mounting and electrical connection of the antenna to the electronic components of the communications device.

U.S. Pat. No. 3,967,276 describes an antenna structure (the so called "Goubau" antenna) comprising four elongated conductors 1, 2, 3 and 4 (see FIG. 1) having dimensions and spacing that are small compared to a wavelength of the applied signal. The conductors are oriented perpendicular to a ground plane 13 with an upper end of each conductor terminated in a conductive plate, identified in FIG. 1 by reference characters 5, 6, 7 and 8. The plates 5, 6, 7 and 8 are spaced apart from each other (i.e., segmented) and capacitively coupled to the ground plane 13. The plates 6, 7 and 8 are oriented parallel to and electrically connected to the ground plane 13 via the conductors 2, 3 and 4. The plate 5 is connected to a signal source (in the transmitting mode) via the conductor 1. In the receiving mode a received signal is supplied to receiving circuitry (not shown), via the conductor 1. Adjacent ones of the plates 5, 6, 7 and 8 are connected by inductive elements 9, 10, 11 and 12.

The plates 5, 6, 7 and 8 and the inductive elements 9, 10, 11 and 12 can be dimensioned (with respect to the inductive elements, dimensioning refers to the inductance and resistance of each inductive element) and spaced apart such that the effective electrical length of the antenna is four times the physical height. For example, in one embodiment the antenna has a physical height of 2.67 inches. When operative with a signal having a wavelength of 60 cm (and thus a frequency of 500 MHz), the antenna is designed to present an effective electrical length of about 10.7 cm. The antenna also exhibits a radiation resistance of about 50 ohms for balancing to a standard transmission line having a 50 ohm impedance.

It is known that a monopole antenna comprising a single flat element spaced apart from a ground plane by a distance of about 2.67 cm has a radiation resistance of only about 3.1 ohms at the same operating frequency of 500 MHz. The antenna thus requires use of an impedance-matching transformer, which substantially reduces antenna efficiency and the radiation bandwidth. Use of the four plates 5, 6, 7 and 8 increases the radiation resistance by the factor N^2, where N is the number of plates.

Typically, the plates 5, 6, 7 and 8 are constructed from sheet metal material, with the elongated conductors 1, 2, 3 and 4 comprising conductive wire. These structures can be relatively expensive to fabricate and thus may not be suitable for use with handheld communications devices where manufacturing cost is an important factor. Also, forming and attaching the inductive elements 9, 10, 11 and 12 is a labor intensive process that is not easily implemented in a printed circuit board manufacturing process. Clearly, an antenna constructed according to the Goubau patent is not ideally suited for mounting on a printed circuit board of a communications handset device.

BRIEF SUMMARY OF THE INVENTION

An antenna constructed according to the present invention comprises a top plate further comprising a plurality of contiguous planar conductive regions, wherein adjacent ones of the plurality of conductive regions define a slot therebetween. A ground plane is spaced apart from and substantially parallel to the top plate. A plurality of legs extend from the top plate toward the ground plane, wherein the plurality of legs is equal in number to the plurality of conductive regions, and wherein each one of the plurality of legs is electrically connected to the top plate. A feed conductor provides signals to the antenna operative in the transmitting mode and receives signals from the antenna operative in the receiving mode. At least a first pair of oppositely disposed legs of the plurality of legs is connected to the feed conductor, and at least a second pair of oppositely disposed legs of the plurality of legs is connected to the ground plane. The invention further comprises a method for forming an antenna, comprising providing a conductive blank having a generally polygonal shape and forming a plurality of slit pairs in the blank, wherein each slit of the plurality of slit pairs extends from a periphery of the blank in a direction of a center region of the blank, and wherein each slit pair defines a tab therebetween, and wherein the tab comprises an edge connected to the blank. The method further comprises bending each tab from a plane of the blank, along the edge connected to the blank.

BRIEF DESCRIPTION OF THE DRAWINGS

The features of the antenna constructed according to the teachings of the present invention will be apparent from the following more particular description of the invention, as illustrated in the accompanying drawings, in which like reference characters refer to the same parts throughout the different figures. The drawings are not necessarily to scale, emphasis instead being placed upon illustrating the principles of the invention.

DETAILED DESCRIPTION OF THE INVENTION

Before describing in detail the particular antenna and method for forming the antenna in accordance with the present invention, it should be observed that the present invention resides primarily in a novel and non-obvious combination of elements and method steps. So as not to obscure the disclosure with details that will be readily apparent to those skilled in the art, certain conventional elements and steps have been described and illustrated with lesser detail, while other elements and steps pertinent to understanding the invention have been described and illustrated in greater detail.

Figure 1:
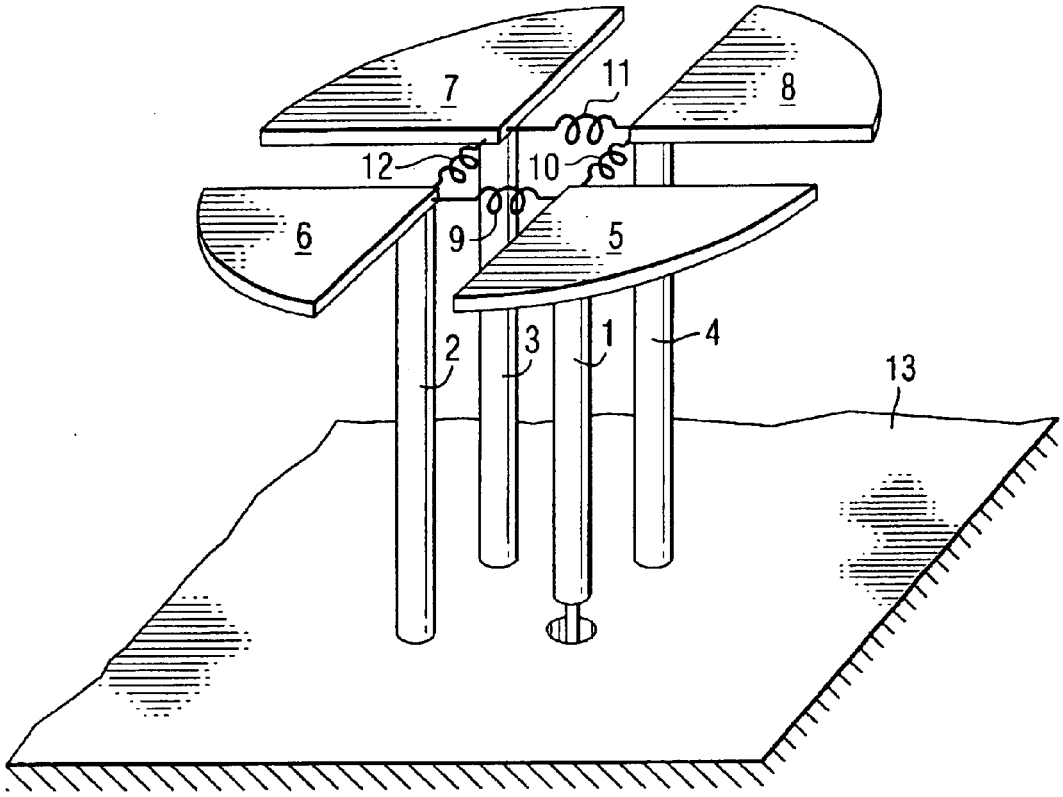
FIG. 1 PRIOR ART
FIG. 1 illustrates a prior art Goubau antenna.
Figure 2:
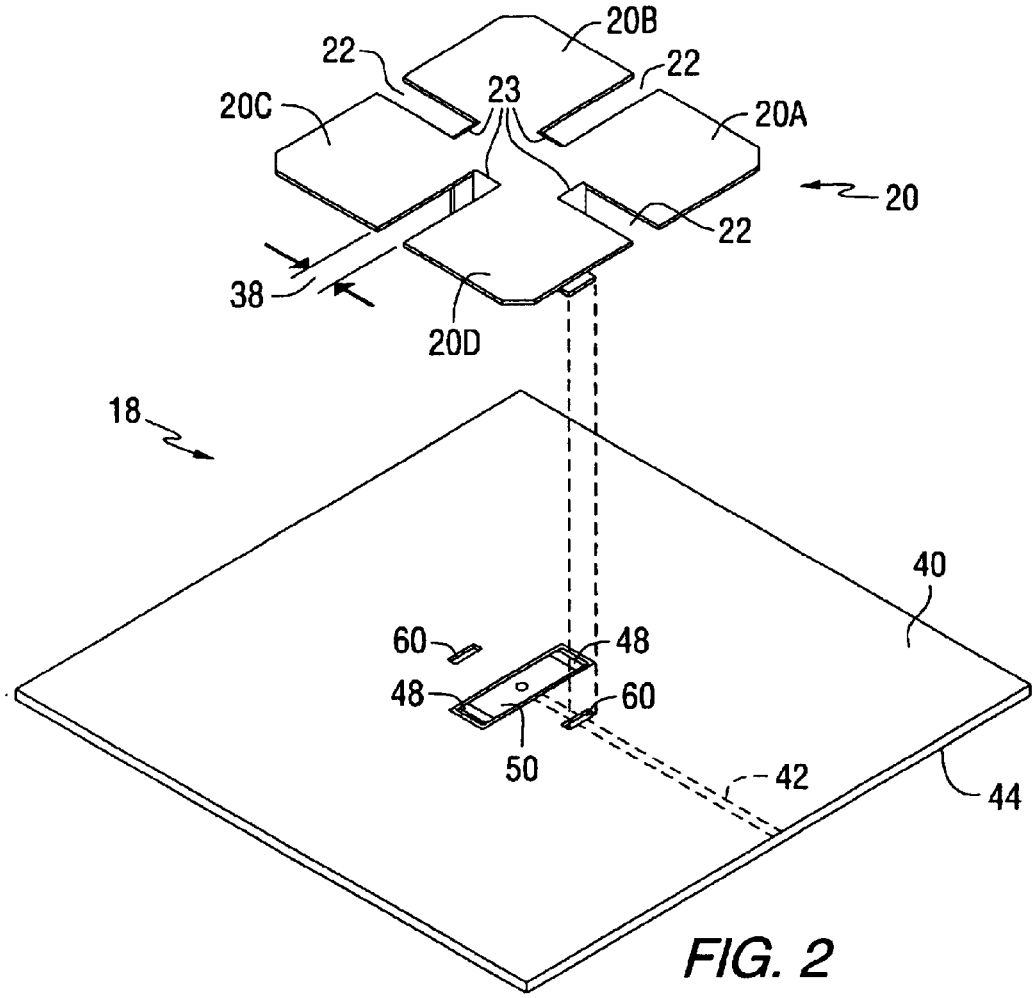
FIGS. 2–4 illustrate various views of an antenna constructed according to the teachings of the present invention.

FIG. 2 is a perspective view of an antenna 18 constructed according to the teachings of the present invention, and comprising a top plate 20, further comprising contiguous planar regions 20A, 20B, 20C and 20D, where two adjacent regions define a slot 22 therebetween. In another embodiment, the top plate comprises four (or more or fewer) physically separated and electrically connected planar regions. The antenna 18 can be referred to as a top-loaded antenna due to the capacitive loading effect caused by interaction between the top plate 20 and a ground plane to be described below.

Legs 24, 26, 28 and 30 extend downwardly from an edge 23 of each slot 22 in a substantially perpendicular orientation with respect to the top plate 20. See an inverted view of the antenna 18 in FIG. 3. Each of the legs 24, 26, 28 and 30 is terminated in a foot 36, forming an angle of about 90° with the respective leg.

The top plate 20, the legs 24, 26, 28 and 30 and the feet 36 are formed from conductive material, such as a phosphor bronze alloy, having a thickness of about 0.008 inches. The material of the antenna elements can further comprise steel, copper, plated steel, aluminum, other conductive materials, or other materials known in the art as suitable for use in a radio frequency antenna.

Since the legs 24, 26, 28 and 30 are conductors, each leg exhibits an inductive reactance. Thus the capacitive reactance provided by the top plate 20 plus the inductive reactance of the legs 24, 26, 28 and 30 forms a series resonant circuit of the antenna 18. Since a dimension 38 in FIG. 2 determines a width of the legs 24, 26, 28 and 30 and the inductance is related to the leg width, the dimension 38 can be varied to provide the desired inductance for the antenna 18.

In another embodiment, in lieu of extending from the slot 22, each one of the legs 24, 26, 28 and 30 extends from an interior region of one of the top plate regions 20A, 20B, 20C and 20D.

The antenna 18 is disposed overlying a ground plane 40. A feed conductor 42 extends from an edge 44 of the ground plane 40 toward an interior region thereof and terminates in two feed pads 48 formed within a conductive feed region 50 that is electrically isolated from the ground plane 40. In the FIG. 2 embodiment, the feed conductor 42 is disposed on a bottom surface of the ground plane 40 and thus depicted in phantom. As will be described further below, the legs 24 and 28 are connected to one of the feed pads 48, and the legs 26 and 30 are connected to the ground plane 40.

Conventional surface mounting techniques can be used to physically and electrically mount the antenna 18 to the ground plane 40. For example, using a solder reflow process, solder is applied to each of the feed pads 48. The foot 36 on each of the legs 24 and 28 is positioned on one of the feed pads 48. The ground plane 40 is then exposed to a heat source for melting or reflowing the solder. When the solder cools, one of the feet 36 is physically and electrically connected to each one of the feed pads 48. In another embodiment, the feet 36 on the legs 24 and 28 are electrically and physically attached to the feed pads 48 using an electrically conductive adhesive.

Each of the legs 26 and 30 is connected to the ground plane 40 via a ground pad 60 formed in and electrically continuous with the ground plane 40. Like the feed pads 48, the ground pads 60 comprise a solder surface for physically and electrically attaching the legs 26 and 30 to the ground plane 40.

When incorporated into a communications device, the antenna 18 can be mounted overlying a printed circuit board carrying a ground plane in a first region underlying the antenna 18 and carrying operative components for the device in a second region thereof. The legs 24, 26, 28 and 30 are affixed to the ground plane region as described above. In one embodiment the ground plane of the printed circuit board has an area larger than an area of the top plate 20. A stripline or microstrip conductor on the printed circuit board serves as the feed conductor 42.

Receiving and transmitting components of the communications device with which the antenna is operative are switchably connected to the feed trace 42 for providing a signal to the antenna 18 when operating in the transmitting mode and for receiving a signal from the antenna 18 when operating in the receiving mode. Such components are known in the art and not illustrated in the Figures.

The elements and process described for attaching the antenna 18 to a printed circuit board are merely exemplary. Those skilled in the art recognize that other physical and electrical attachment techniques can be used as determined by the configuration and layout of the printed circuit board and the of the wireless device with which the antenna 18 operates. Additionally, the location of the feed pads 48 and the ground pads 60 on the ground plane 40 will be established consistent with the available space on the printed circuit board and the desired antenna performance parameters, and thus may differ from the illustrations and description herein.

Figure 4:
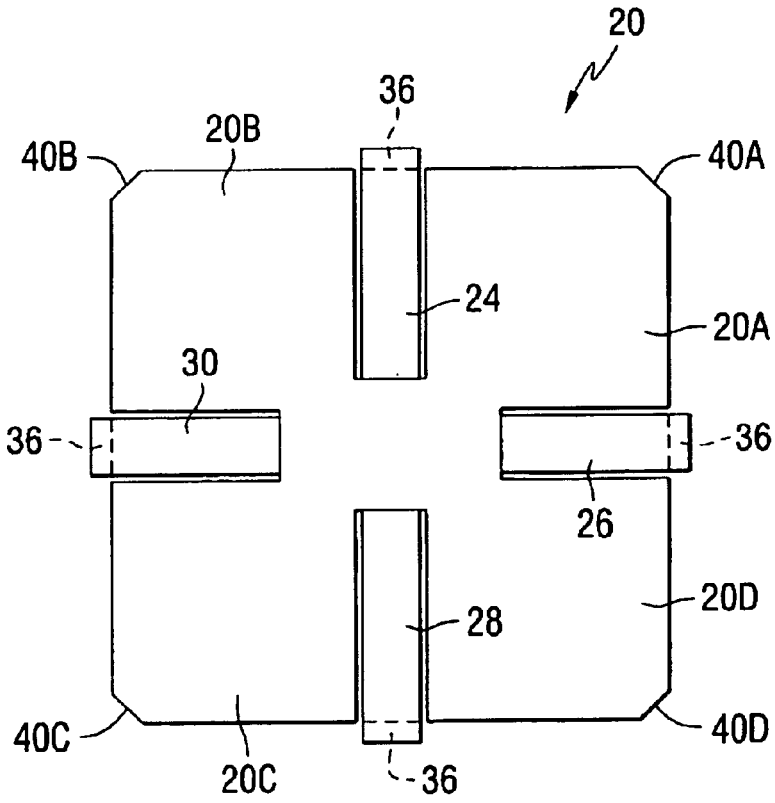

FIG. 4 illustrates a plan view of the antenna 18.

Figure 3:
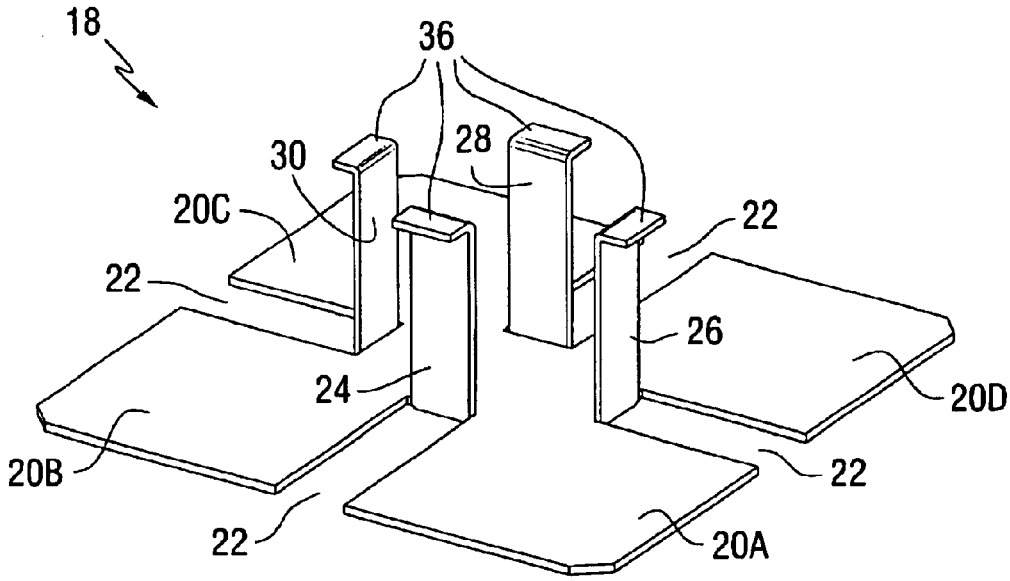

Although the regions 20A–20D of the top plate 20 are illustrated in FIGS. 2–4 as quadrilateral regions, this geometry is merely exemplary. The regions 20A–20D can be formed from other closed curves, including, polygons, or other closed curves having one or more sides selected from between straight lines and curves. The bevels 40A, 40B, 40C and 40D (see FIG. 4) are not necessarily required for operation of the antenna 18.

Figure 5:
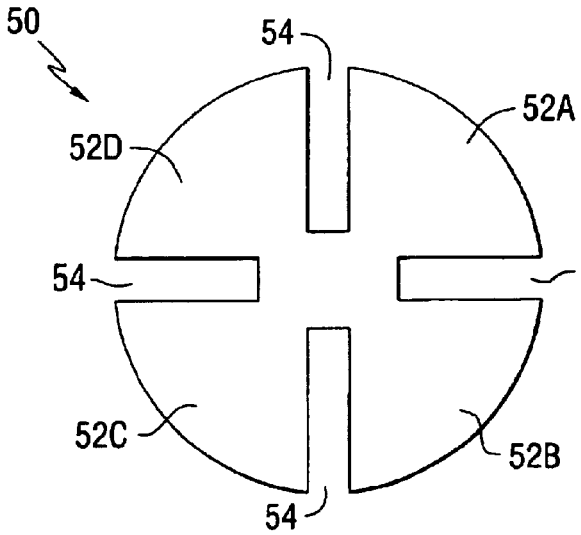
FIG. 5 illustrates a top plate for another embodiment of an antenna constructed according to the teachings of the present invention.

For example, FIG. 5 illustrates an embodiment of an antenna according to the teachings of the present invention comprising a top plate 50 further comprising a plurality of circular sectors 52A, 52B, 52C and 52D. As in the embodiments described above, legs extend from the circular sectors 52A, 52B, 52C and 52D or from slots 54 defined by adjacent circular sectors to a ground plane for connection to the ground plane and to a feed conductor.

The regions 20A–20D provide top loading for the antenna 18, allowing reduction of the antenna physical height (i.e., the distance between the top plate 20 and the ground plane 40, which is also the length of the legs 24, 26, 28 and 30) to less than a quarter wavelength at the operating frequency. Top loading of the antenna 18 also tends to increase the bandwidth, as is known in the art, relative to the bandwidth of a short dipole antenna, which is much less than a wavelength in length. Such short dipoles have a relatively high inductance and a relatively low radiation resistance, resulting in relatively high Q factor and thus a relatively narrow bandwidth.

Although four regions 20A–20D are illustrated herein, other embodiments of an antenna constructed according to the teachings of the present invention comprise more or fewer conductive regions and provide corresponding desired antenna operating characteristics. Use of N legs or N regions in the top plate 20 increases the radiation resistance relative to the antenna reactance (where the reactance represents the energy stored in the antenna and not radiated), lowering the Q factor and increasing the operational bandwidth, i.e., the antenna bandwidth widens. According to the present invention the radiation resistance is increased by a factor of N^2 compared to a conventional short dipole or monopole. The higher radiation resistance also provides a better match to a 50 ohm transmission line feeding the antenna 18. If this is a desired antenna characteristic, (i.e., wideband versus narrow band operation) the number of conductive regions can be increased to achieve a desired radiation resistance.

Current flow in the two feed legs 24 and 28 is in the same direction (in phase), resulting in mutually coupled currents. Also, current flow in the two ground legs 26 and 30 is in the same direction. As a result of the in-phase current flow and the higher radiation resistance as described above, the electromagnetic energy emitted by the antenna 18 in the transmitting mode is maximized.

In one exemplary embodiment, the top plate 20 is about one inch square and mounted about 0.3 inches above the ground plane 40, which is about two inches square. An antenna constructed according to these dimensions operates at a resonant frequency of about 2.45 GHz with a bandwidth of about 150 MHz, where the bandwidth is defined as the range of frequencies for which the antenna exhibits a voltage standing wave ratio of less than about 2. The antenna 18 operates with an efficiency of about 93%. The dimensions of the top plate 20 are typically greater than the distance between the top plate 20 and the ground plane 40. As discussed above, this distance is typically much smaller than a quarter wavelength at the operating frequency. In other embodiments, the distance between the ground plane 40 and the top plate 18 can extend up to about 0.7 inches.

Since the legs 24 and 28 are the principle radiating antenna structures, the signal polarization is vertical. Little radiation is emitted from or received by the top plate 20 and the ground plane 40.

The top plate regions 20A–20D and the legs 24, 26, 28 and 30 are illustrated in the Figures as symmetrical about a central antenna axis. Thus the antenna 18 provides omnidirectional radiation coverage in the azimuth direction. Employing an asymmetrical top plate 20 or an asymmetrical configuration of the legs 24, 26, 28 and 30 produces an asymmetrical azimuthal pattern. Asymmetry can be achieved, for example, by varying the shape of one or more of the conductive regions 20A–20D.

The dimensions and shapes of the various antenna elements and their respective features as described herein can be modified to permit operation in other frequency bands with other operational characteristics, including bandwidth, radiation resistance, input impedance, etc. Generally, changing the size of the various features changes only the antenna resonant frequency. The antenna can therefore be scaled to another resonant frequency by dimensional variation. For example, increasing the antenna volume, e.g., increasing the distance between the top plate 20 and the ground plane 40, tends to decrease the resonant frequency. Also, when the height is increased, the size of the top plate 20 should also be increased to provide the appropriate capacitive loading at the new resonant frequency.

In one embodiment an antenna constructed according to the teachings of the present invention is monolithic, i.e., the antenna can be formed from a single piece of conductive material. The antenna is lightweight and configured for surface mounting on a printed circuit board of a communications device, in particular, the printed circuit board of a communications handset device. In certain embodiments where the distance of the top plate 20 above the ground plane 40 permits, the antenna 18 can be mounted on a PCMCIA card for sending and receiving radio frequency signals in conjunction with a wireless communications device. The antenna's efficiency and bandwidth are greater than provided by prior art antennas of equal height and including a solid dielectric (with a dielectric constant Dk>1) material between the ground plane and the top plate. The use of multiple vertical feed members and symmetrically-opposed multiple vertical shunt members cancels the surface currents on the top plate, optimizing the purity of the vertically polarized azimuthal radiation pattern.

A process for forming the antenna 18 comprises providing a blank constructed from a material having properties suitable for use as an antenna. The blank further comprises a length and a width dimensions to form the top plate 20. The legs 24, 26, 28 and 30 are formed by first forming two parallel spaced-apart slits extending from an edge toward a center region of the blank. The resulting structure thus comprises four tabs attached to the blank along the edge 23. Each tab is then bent downwardly along the edge 23 from the plane of the blank to form one of the legs 24, 26, 28 and 30, and the corresponding slot 22. The legs 24 and 28, which are connected to the feed pads 48, lie on an axis that is perpendicular to an axis passing through the legs 26 and 30, which are connected to the ground pads 60. Material of the blank remaining after the legs 24, 26, 28 and 30 are formed comprises the top plate 20. The feet 36 are formed by bending a region at a terminal end of each leg 24, 26, 28 and 30 into an approximately perpendicular relation with the leg.

While the invention has been described with reference to preferred embodiments, it will be understood by those skilled in the art that various changes may be made and equivalent elements may be substituted for elements thereof without departing from the scope of the present invention. The scope of the present invention further includes any combination of the elements from the various embodiments set forth herein. In addition, modifications may be made to adapt a particular situation to the teachings of the present invention without departing from its essential scope thereof. For example, different sized and shaped elements can be employed to form an antenna according to the teachings of the present invention. Therefore, it is intended that the invention not be limited to the particular embodiment disclosed as the best mode contemplated for carrying out this invention, but that the invention will include all embodiments falling within the scope of the appended claims.

What is claimed is:

1. An antenna comprising:

a top plate comprising a plurality of contiguous planar conductive regions, wherein adjacent ones of the plurality of conductive regions define a slot therebetween;

a ground plane spaced apart from and substantially parallel to the top plate;

a plurality of legs extending from the top plate toward the ground plane, wherein the plurality of legs is equal in number to the plurality of conductive regions, and wherein each one of the plurality of legs is electrically connected to the top plate;

a feed conductor;

wherein at least a first pair of oppositely disposed legs of the plurality of legs is connected to the feed conductor; and wherein at least a second pair of oppositely disposed legs of the plurality of legs is connected to the ground plane.

2. The antenna of claim 1 further comprising a substrate, and wherein the ground plane and the feed conductor are disposed on the substrate, and wherein the feed conductor is electrically isolated from the ground plane.

3. The antenna of claim 1 further comprising a region of dielectric between the top plate and the ground plane.

4. The antenna of claim 3 wherein the region of dielectric comprises an air dielectric.

5. The antenna of claim 1 wherein each one of the plurality of conductive regions comprises a closed planar figure having boundaries selected from between straight lines and curves.

6. The antenna of claim 1 wherein each one of the plurality of conductive regions comprises a sector of a circle.

7. The antenna of claim 1 wherein each one of the plurality of conductive regions comprises a rectangle.

8. The antenna of claim 1 wherein the plurality of conductive regions are capacitively coupled to the ground plane.

9. The antenna of claim 1 wherein each one of the plurality of legs extends from the slot defined between two adjacent conductive regions.

10. The antenna of claim 1 wherein each one of the plurality of legs extends from one of the plurality of conductive regions.

11. The antenna of claim 1 wherein a material of the top plate and the plurality of legs comprises phosphor bronze.

12. The antenna of claim 1 wherein the plurality of conductive regions are spaced substantially equidistant from a central axis of the antenna.

13. The antenna of claim 1 wherein the plurality of legs are spaced substantially equidistant from a central axis of the antenna.

14. An antenna comprising:

a conductive plate defining a plurality of slots therein extending from a periphery toward a center region of the plate and defining a slot edge thereat, wherein the plurality of slots segregate the plate into a like plurality of contiguous regions;

a ground plane spaced apart from and substantially parallel to the plate;

a signal feed;

a plurality of conductors equal in number to the number of regions, wherein each one of the plurality of conductors extends from one of a region and a slot edge in a direction perpendicular to the plate;

a first set of the plurality of conductors connected to the ground plane; and a second set of the plurality of conductors connected to the signal feed.

15. The antenna of claim 14 wherein the slot edges are equidistantly disposed relative to a center antenna axis of the antenna.

* * * * *